US005450964A

United States Patent [19]

Miller

[11] Patent Number: 5,450,964

[45] Date of Patent: Sep. 19, 1995

[54] HANGER SYSTEM INCLUDING A HANGER FOR SELECTIVELY SUSPENDING A BAG

[76] Inventor: Richard L. Miller, 1700 E. Quincy Ave., Englewood, Colo. 80110

[21] Appl. No.: 240,855

[22] Filed: May 10, 1994

[51] Int. Cl.[6] ..... B65D 33/14

[52] U.S. Cl. ..... 206/554; 383/13

[58] Field of Search ..... 206/554, 390; 383/7, 383/9, 13, 15, 20, 22–25, 37

[56] References Cited

U.S. PATENT DOCUMENTS

| | | | |
|---|---|---|---|
| 3,140,038 | 7/1964 | Laguerre | 383/15 |
| 3,463,381 | 8/1969 | Wainberg | 383/15 |
| 4,000,768 | 1/1977 | Siegel | 383/23 |
| 4,201,299 | 5/1980 | Bumgarner et al. | 206/554 |
| 4,590,610 | 5/1986 | Rhyne | 383/23 |
| 4,834,553 | 5/1989 | Bennett | 383/23 |
| 5,183,158 | 2/1993 | Boyd et al. | 206/554 |
| 5,290,104 | 3/1994 | Sengewald | 206/554 |

FOREIGN PATENT DOCUMENTS

| | | | |
|---|---|---|---|
| 0398289 | 2/1966 | Switzerland | 206/554 |
| 0204392 | 5/1966 | Switzerland | 383/13 |
| 1008293 | 10/1965 | United Kingdom | 206/554 |
| 1073913 | 6/1967 | United Kingdom | 206/554 |
| 2225567 | 6/1990 | United Kingdom | 383/15 |

OTHER PUBLICATIONS

"Front Cover", Letter to *Wall Street Journal* Delivery Supervisors and Carriers, undated.

*Primary Examiner*—Jimmy G. Foster

[57] ABSTRACT

A hanger system including a flexible, resilient plastic hanger for selectively suspending a bag having a pair of holes extending therethrough. The hanger includes a pair of opposing, spaced ears, the distance between the ears being longer than the distance between the bag holes. The hanger may be flexibly deformed from its normal state so that each ear may be selectively inserted into or retracted from a respective one of the bag holes. The hanger system may also include at least one of the bags, and if a plurality of bags are used, then they may be heat melted together along an upper edge.

19 Claims, 3 Drawing Sheets

HANGER SYSTEM INCLUDING A HANGER FOR SELECTIVELY SUSPENDING A BAG

BACKGROUND OF THE INVENTION

The present invention relates to a hanger system especially useful for distributing newspapers in plastic bags, however, the invention is also applicable to other uses and fields.

It is well known that newspapers may be distributed to a customer by folding a newspaper, placing the folded newspaper in a plastic bag, and then throwing the bag containing the newspaper onto a porch, steps, or a driveway. The plastic bag helps protect the newspaper from rain, snow, and other elements. In an effort to increase the speed and efficiency of the foregoing delivery of newspapers in plastic bags, special bags and hangers for the bags have been developed, especially when the newspaper delivery person delivers the newspapers from an automobile or other vehicle.

A conventional way of assembling the bags for use in distributing newspapers is as follows. Each bag is formed of two rectangular sheets of plastic joined along the bottom and two side edges such that a pocket is formed with an opening along the top edge. One rectangular sheet is slightly longer than the other rectangular sheet: such that a flap extends above the pocket opening. The longer sheet is scored in a line in the region proximate to the pocket opening, such that the pocket portion may be disattached from the flap portion along the score line. Several of such bags are typically joined together along their respective flaps.

In one known embodiment, a cardboard handle is stapled to each of the flaps of the overlapping bags, with the cardboard handle having a hook so that the entire assembly may be carried by the finger of a person and may also be selectively suspended from the mounting of an automobile rear view mirror. A disadvantage of the stapled cardboard handle is that the assembly process is very labor intensive. The handles are not reuseable and therefore the materials tend to become expensive. Also the cardboard and staples present a minor disposal problem.

In yet another embodiment, the flap portions of the bags are fused by a heat stabbing process. A pair of holes created by heat pins extends through the flap sections of each bag and are adapted to be suspended from a wire hanger which in turn is suspended from a cord wrapped around the mounting of an automobile rear view mirror. Such a system also includes a wire spreader that maintains the cord in a horizontally separated condition below the rear view mirror so as to inhibit the assembly from twirling when the automobile is in motion. A disadvantage of the wire hanger system is that the wire hangers are relatively expensive to make and are often misplaced or lost by newspaper distributors.

SUMMARY OF THE INVENTION

The present invention relates to a hanger system including a flexible, resilient plastic hanger for selectively suspending a bag having a pair of holes extending therethrough. The hanger includes a pair of opposing, spaced ears, the distance between the ears being longer than the distance between the bag holes. The hanger may be flexibly deformed from its normal state so that each ear may be selectively inserted into or retracted from a respective one of the bag holes. The hanger system may also include at least one of the bags, and if a plurality of bags are used, then they may be heat melted together along an upper edge.

BRIEF DESCRIPTION OF THE DRAWINGS

The present invention will be described with reference to the accompanying drawings, wherein.

DESCRIPTION OF A PREFERRED EMBODIMENT

Figure 2:
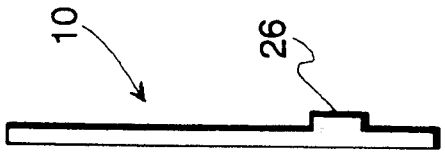
FIG. 2 is an end view of the hanger shown in FIG. 1.

The present invention will be described with reference to the accompanying drawings, wherein like reference numerals refer to the same item.

Figure 1:
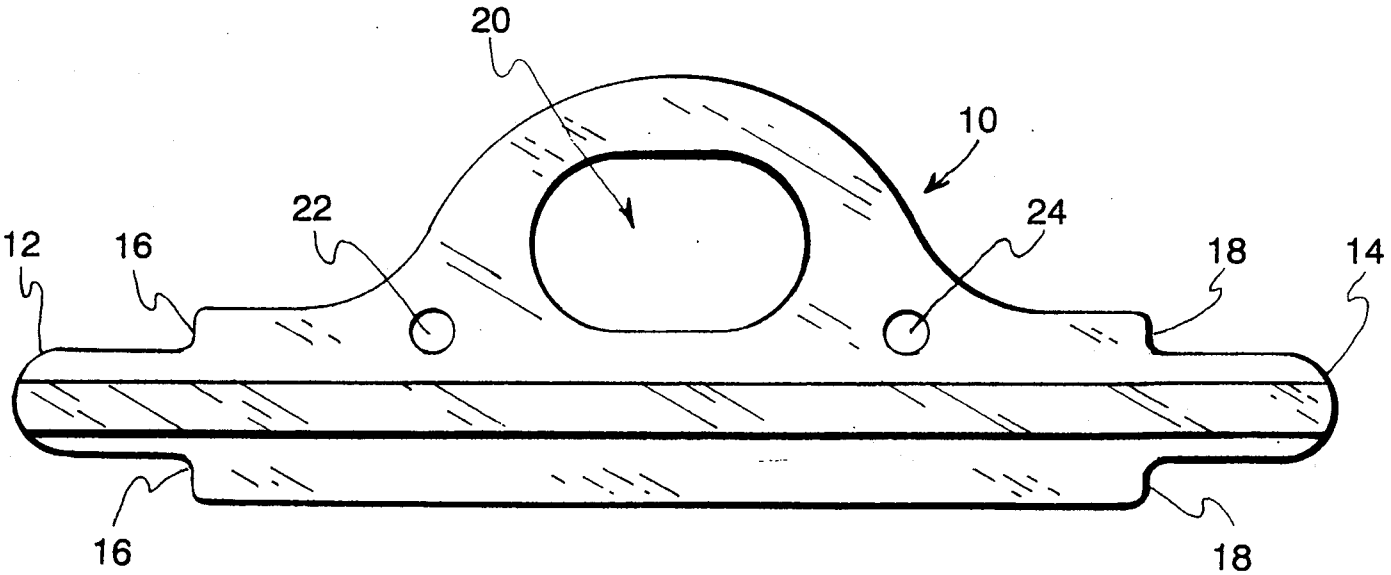
FIG. 1 is a front view of a hanger that may be used in the hanger system of the present invention.

There is shown in FIG. 1 a hanger 10 having a pair of spaced, laterally opposing ears 12, 14. The distance from the tip of one ear to the: tip of the other, opposing ear is preferably 7 inches. Each ear 12, 14 is preferably $\frac{7}{8}$ inch long and $\frac{1}{2}$ inch wide, with the tip being rounded. Each ear 12, 14 joins the body of the hanger 10 at relatively wider abutment regions 16, 18, respectively.

The hanger 10 also includes a relatively large hole 20 adapted to receive a pair of human fingers and forming a ring shaped section of the hanger 10. The hanger 10 also includes a pair of hanger holes 22, 24 spaced apart on either side of the finger hole 20. As will be more fully appreciated later, the ring created by the finger hole 20 may instead be fashioned in the shape of a conventional hook. As best shown in FIG. 2, the hanger 10 possesses a generally rectangular stiffening rib 26 that extends straight across the hanger from the tip of one ear 12 to the tip of the other ear 14.

The hanger 10 is preferably integrally fashioned of a unitary material, such as plastic. Also, the hanger is constructed of such a material and has dimensions such that the hanger 10 is flexible and resilient whereby the hanger 10 is normally planar, but may be flexibly deformed in a bow configuration from its normal planar state.

Figure 3:
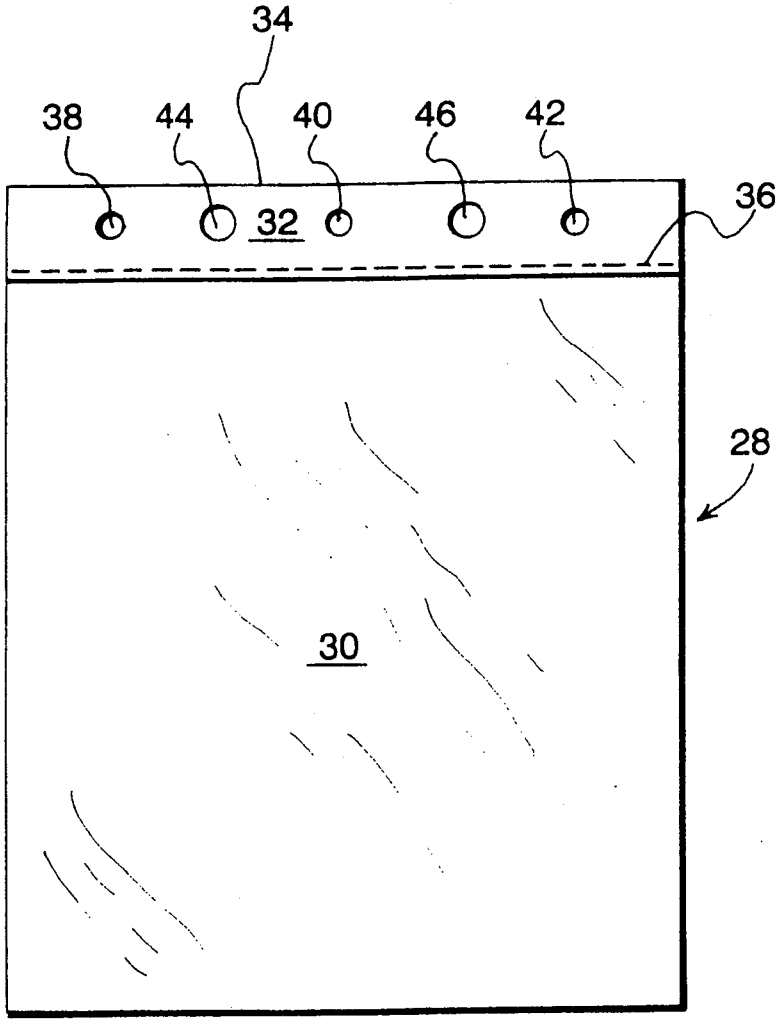
FIG. 3 is a front view of a plastic bag that may be utilized in the hanger system of the present invention.

The hanger system of the present invention also may include a special bag adapted for cooperative use with the hanger 10. As best shown in FIG. 3, the bag 28 is preferably formed of two rectangular sheets 30, 32 of plastic joined along the bottom and two side edges such that a pocket is formed with an opening along the top edge. One rectangular sheet 32 is slightly longer than the other rectangular sheet 30 such that a flap extends above the pocket opening. The longer rectangular sheet 32 is also preferably scored in a line 36 slightly above and adjacent to the pocket opening.

A plurality of the bags 28 may be disposed in an overlapping relation and then joined together by conventional heat stabbing process by which hot pins are driven through the overlapping flaps 24 of the bags at three spaced locations, which results in holes 38, 40, 42 extending through each of the flaps 34 of the overlapping bags 28. The bags melt and fuse in the region immediately adjacent to each of the heat pin holes 38, 40, and 42, which results in the bags 28 being joined together along their flaps 34. In accordance with the present invention, two additional wicket holes 44, 46 are drilled or otherwise made through each of the flaps 34 of the overlapping bags 28. The diameter of each wicket hole 44, 46 is preferably at least as wide as the ears 12, 14 and preferably is ½ inch wide. Each of the wicket holes 44, 46 is bilaterally disposed on either side of the longitudinal center line of the bags 28 and are disposed from each other preferably at a distance of 5 inches.

Typically each bag 28 is 9½ inches wide and 21½ inches long, with a flap or lip extending 1½ inches above the perforation and the pocket opening. Also, typically, fifty bags 28 are joined together in the heat stabbing operation.

Figure 4:
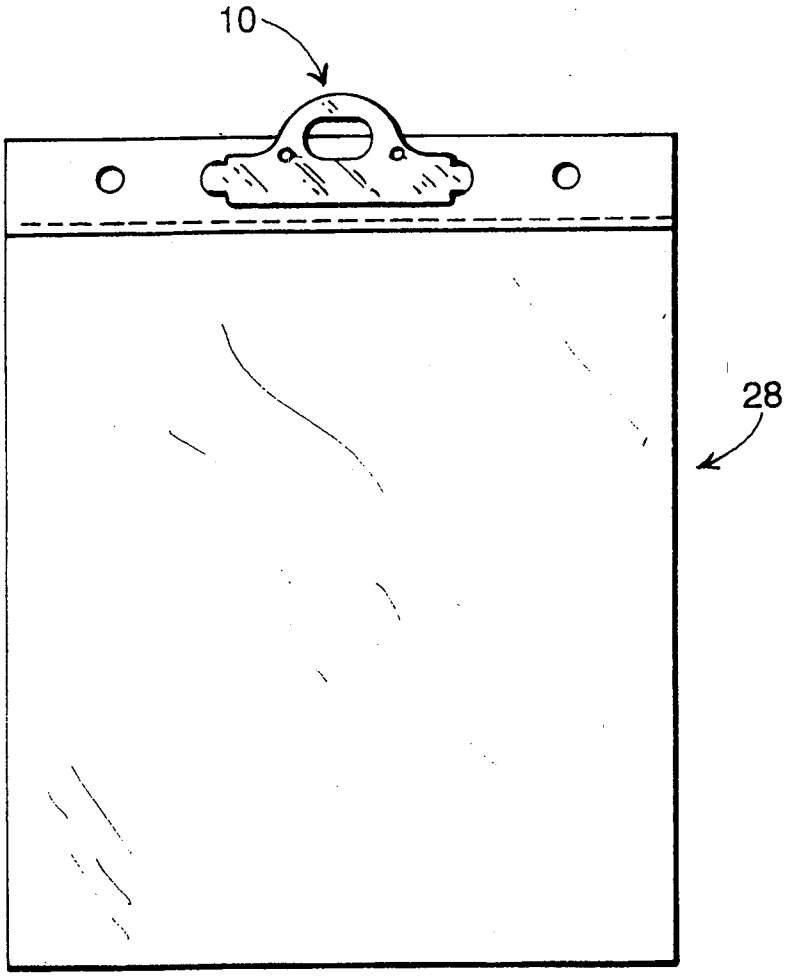
FIG. 4 is a front view of a hanger system according to the present invention that utilizes the hanger shown in FIGS. 1 and 2 and the bag shown in FIG. 3.

The hanger 10 may be selectively attached to one or more bags 28 (whether joined together or not) as best shown in FIG. 4. In order to attach the handle 10 to one or more bags 28, the handle is first flexibly formed or bent into a bow shape such that the ears 12, 14 are closer to each other. Then, one of the ears, for example the ear 14, is inserted into the corresponding wicket hole 46. Next, the other ear 12 is inserted into the other wicket hole 44. Obviously, the order of insertion may be reversed. The hanger 10 may be retracted from the or more bags 28 by a reverse process.

Preferably, when the hanger 10 is attached to the one or more bags 28 as shown in FIG. 4, the abutment regions 16, 18 of the hanger will forcefully press against the region of the bags 28 surrounding the wicket holes 44, 46. This condition may be accomplished by having the distance between the abutment regions 16, 18 being at least as long as the distance between the wicket holes 44, 46, whereby the hanger 10 is maintained in a very slightly bowed condition when attached to the one or more bags 28 as shown in FIG. 4. This condition also helps insure that the hanger 10 will not slide laterally relative to the one or more bags 28.

Figure 5:
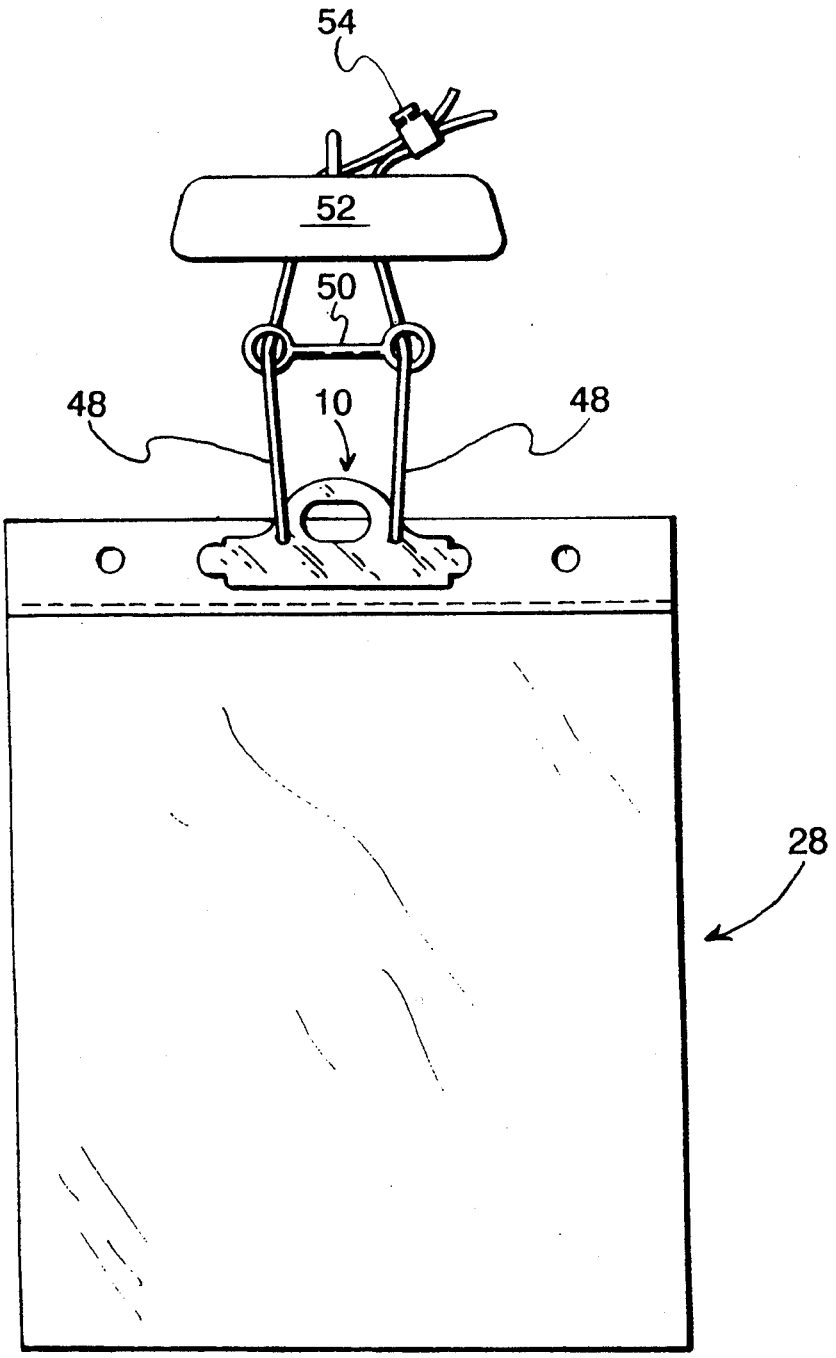
FIG. 5 is a plan view of the hanger system according to the present invention utilizing the hanger shown in FIGS. 1 and 2 and a plurality of the bags shown in FIG. 3.

The hanger 10 of the present invention may also include conventional components such as a hanging cord 48 and a wire spreader 50 as shown in FIG. 5. The cord 48, which may be a string, shoelace, or the like, may be looped through the hanger holes 22, 24 then around the mount of an automobile rear view mirror 52. The ends of the cord 48 may be tied or may be joined together by means of a conventional plunger clamp 54. The cord 48 may also extend through the spaced eyelets of a wire spreader 50, which helps maintain the portions of the cord 48 in a horizontally spaced relation and which helps prevent twirling of the bags 28. The wire spreader 50 utilizes inertial principles in much the same way that an ice skater turns more quickly when the ice skater's arms and legs are maintained close to the skater's body than when the ice skater's arms and legs are extended outwardly.

It should be appreciated that the hanger 10 of the present invention is relatively inexpensive to manufacture and can be reused. Also, the only disposal problem with the hanger system involves the flaps 34 of the plastic bags 28, without any cardboard or staples.

It is to be understood that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed and reasonable equivalents thereof.

I claim:

1. In combination with at least one bag possessing a pair of bag holes extending therethrough, a hanger for selectively suspending said bag, said hanger including a pair of opposing, spaced ears, the width of each of said ears being substantially no greater than the diameter of each of said bag holes, the distance between said ears being longer than the distance between said bag holes when said hanger is in an undeformed state, said hanger being flexible and resilient such that when said hanger is flexibly deformed from its undeformed state, the distance between said ears shortens whereby each of said ears may be selectively inserted through or retracted from a respective one of said bag holes; and the region of said hanger adjacent to each of said ears being wider than the diameter of each of said bag holes and wherein said adjacent regions are spaced apart a distance substantially at least as long as the distance between said bag holes, each of said ears received through a respective one of said bag holes, regions of said bag surrounding said bag holes disposed in abutment with said adjacent regions thereby causing said hanger to be slightly deformed so as to exert a resiliently extensible force against the bag in the regions of the bag holes.

2. The combination according to claim 1 wherein said hanger is integrally fashioned of a unitary material.

3. The combination according to claim 2 wherein said material consists of plastic.

4. The combination according to claim 1 further including mounting means for selectively, suspendably mounting said hanger from another object.

5. The combination according to claim 4 wherein said mounting means includes a ring.

6. The combination according to claim 4 possessing a pair of spaced hanger holes adapted to receive a cord.

7. The combination according to claim 1 further including a stiffening rib extending substantially the entire length between said ears.

8. A hanger system for suspending a plurality of bags, comprising:

(a) at least two bags disposed in overlying relation, each of said bags having a pair of holes extending therethrough substantially proximate to one edge thereof, said pairs of holes in said at least two bags disposed in substantial alignment; and (b) a hanger having a pair of opposing, spaced ears, the width of each of said ears being substantially no greater than the diameter of each of said bag holes, the distance between said ears being slightly longer than the distance between the holes of each of said pairs of bag holes when said hanger is in an undeformed state, said hanger being flexible and resilient such that when said hanger is flexibly deformed from its undeformed state, the distance between said ears shortens whereby each of said ears may be selectively inserted through or retracted from said aligned holes of said at least two bags, the region of said hanger adjacent to each of said ears being wider than the diameter of each of said bag holes and wherein said adjacent regions are spaced apart a distance substantially at least as long as the distance between the holes of each of said pairs of bag holes, each of said ears received through respective ones of said bag holes, regions of said bags surrounding said bag holes disposed in abutment with said adjacent regions thereby causing said hanger to be slightly deformed so as to exert a resiliently extensible force against the bags in the regions of the bag holes.

9. A hanger system according to claim 8 wherein said hanger possesses a pair of spaced holes and wherein said system further includes a cord adapted to extend through said hanger holes and adapted to loop around an object whereby said hanger may be suspended by said cord from said object.

10. A hanger system according to claim 9 further including means for maintaining portions of said cord in a horizontally spaced relationship.

11. A hanger system according to claim 8 wherein said hanger is integrally fashioned of a unitary material.

12. A hanger system according to claim 11 wherein said material consists of plastic.

13. A hanger system according to claim 8 further including mounting means for selectively, suspendably mounting said hanger from another object.

14. A hanger system according to claim 13 wherein said mounting means includes a ring.

15. A hanger system according to claim 13 wherein said mounting means includes a pair of spaced hanger holes in said hanger adapted to receive a cord.

16. A hanger system according to claim 8 further including a stiffening rib on said hanger extending substantially the entire length between said ears.

17. A hanger system for suspending an article including (a) a plurality of plastic bags arranged in an overlying relation, each bag formed of two rectangular sheets of plastic joined along the bottom and two side edges such that a pocket is formed with an opening along the top edge, one rectangular sheet being slightly longer than the other rectangular sheet such that a flap extends above the pocket opening, the longer sheet being scored in a line in the region proximate to the pocket opening such that the pocket portion may be disattached from the flap portion along the score line, said bags being joined together at their respective flaps, each bag possessing a pair of spaced holes in its flap, and the holes in each flap being aligned with the bag holes in the flaps of the other bags; and (b) a hanger including a pair of opposing, spaced ears, the width of each of said ears being substantially no greater than the diameter of each of said bag holes, the distance between said ears being longer than the distance between said bag holes when said hanger is in an undeformed state, said hanger being flexible and resilient such that when said hanger is flexibly deformed from its undeformed state, the distance between said ears shortens whereby each of said ears may be selectively inserted into or retracted from a respective one of said bag holes.

18. A hanger system for suspending an article according to claim 17 wherein said bags are joined together at their respective flaps by heat melting.

19. A hanger system for suspending an article according to claim 17 wherein the region of said hanger adjacent to each of said ears is wider than the diameter of each of said bag holes and wherein said adjacent regions are spaced apart a distance substantially at least as long as the distance between said bag holes whereby when each of said ears is selectively inserted into a respective one of said bag holes, said hanger is slightly deformed and tends to exert a resiliently extensible force against the bag in the region of the bag holes.

* * * * *